US007963596B2

(12) United States Patent
Efthimiou

(10) Patent No.: US 7,963,596 B2
(45) Date of Patent: Jun. 21, 2011

(54) REMOVABLE AND ADJUSTABLE CANOPY COVERING

(76) Inventor: Peter Efthimiou, Little Elm, TX (US)

( * ) Notice: Subject to any disclaimer, the term of this patent is extended or adjusted under 35 U.S.C. 154(b) by 43 days.

(21) Appl. No.: 12/544,856

(22) Filed: Aug. 20, 2009

(65) Prior Publication Data

US 2010/0045081 A1 Feb. 25, 2010

Related U.S. Application Data

(60) Provisional application No. 61/189,707, filed on Aug. 22, 2008.

(51) Int. Cl.
*A47C 7/62* (2006.01)
*A47C 7/66* (2006.01)

(52) U.S. Cl. ..... 297/184.11; 297/184.1; 297/184.15; 297/184.17

(58) Field of Classification Search ..... 297/184.1, 297/184.11, 184.14, 184.15, 184.17
See application file for complete search history.

(56) References Cited

U.S. PATENT DOCUMENTS

| | | | | | |
|---|---|---|---|---|---|
| 270,224 | A * | 1/1883 | Johnson et al. | ..... | 297/184.17 X |
| 292,941 | A * | 2/1884 | Nunnelley | ..... | 297/184.17 |
| 663,279 | A * | 12/1900 | Jones | ..... | 297/184.11 X |
| 1,946,137 | A * | 2/1934 | Frost | ..... | 297/184.17 |
| 3,007,735 | A * | 11/1961 | Cohn | ..... | 297/184.17 |
| 4,063,318 | A * | 12/1977 | Nicholson | ..... | 297/184.17 X |
| 4,093,305 | A * | 6/1978 | Staroste et al. | ..... | 297/184.17 |
| 4,201,416 | A | 5/1980 | Vanderminden | | |
| 4,506,689 | A * | 3/1985 | Fiddler | ..... | 297/184.11 X |
| 4,630,545 | A * | 12/1986 | Michel | ..... | 297/184.14 X |
| 4,809,724 | A | 3/1989 | Fuser | | |
| 4,810,030 | A * | 3/1989 | Lewis | ..... | 297/184.17 |
| 4,915,120 | A * | 4/1990 | Ziolkowski | ..... | 297/184.17 X |
| 4,978,166 | A * | 12/1990 | James | ..... | 297/184.17 |
| 5,013,085 | A | 5/1991 | Craig | | |
| 5,096,257 | A | 3/1992 | Clark | | |
| 5,188,380 | A * | 2/1993 | Tucek | ..... | 297/184.17 X |
| 5,203,363 | A | 4/1993 | Kidwell et al. | | |
| 5,320,405 | A * | 6/1994 | Foster et al. | ..... | 297/184.17 |
| 5,441,067 | A * | 8/1995 | James et al. | ..... | 297/184.15 X |
| 5,579,797 | A | 12/1996 | Rogers | | |
| 5,921,258 | A * | 7/1999 | Francois | ..... | 297/184.11 X |
| 5,967,601 | A | 10/1999 | Gillins | | |
| 6,209,611 | B1 * | 4/2001 | Johnson | ..... | 297/184.11 X |
| 6,244,286 | B1 | 6/2001 | Russo | | |
| 6,443,522 | B1 * | 9/2002 | Kain et al. | ..... | 297/184.17 |
| 6,764,133 | B2 * | 7/2004 | Osato | ..... | 297/184.17 X |
| 6,789,557 | B1 * | 9/2004 | Wahl, Jr. | ..... | 297/184.11 X |
| 6,845,780 | B2 | 1/2005 | Bishirjian | | |
| 7,118,173 | B2 * | 10/2006 | Kassai et al. | ..... | 297/184.17 X |
| 7,311,355 | B2 * | 12/2007 | Fargason, III | ..... | 297/184.15 |
| 7,431,388 | B2 | 10/2008 | Sharapov | | |
| 7,527,331 | B2 * | 5/2009 | Fargason, III | ..... | 297/184.15 |

(Continued)

*Primary Examiner* — Rodney B White
(74) *Attorney, Agent, or Firm* — Stephen Liu; Mari Stewart

(57) ABSTRACT

An adjustable seating canopy that is removably mounted to a seat. The canopy includes a set of frame elements that defines a curved shape of the canopy. The canopy includes a set of air channels that are formed by partially joining two layers of fabric that form the canopy. In addition, the set of air channels are oriented substantially perpendicular to an arced axis traveled by at least one frame element in the set of frame elements. The canopy includes a set of pivoting mechanisms attached to one or more frame elements which causes the canopy to be adjustably positioned above the chair along the arced axis. The canopy also includes a set of detachable clamping devices for mounting the canopy to the chair.

5 Claims, 5 Drawing Sheets

U.S. PATENT DOCUMENTS

2007/0145792 A1 6/2007 Miller
2007/0187999 A1 8/2007 Zapater
2008/0100102 A1* 5/2008 Fargason ..... 297/184.17
2009/0179463 A1* 7/2009 Fargason, III ..... 297/184.17 X

* cited by examiner

REMOVABLE AND ADJUSTABLE CANOPY COVERING

PRIORITY CLAIM

This patent claims priority to the provisional U.S. patent application No. 61/189,707 filed Aug. 22, 2008.

BACKGROUND OF THE INVENTION

1. Field of the Invention

The present invention relates generally to chairs and in particular to an accessory for chairs. Still more particularly, the present invention relates to a removable and adjustable canopy for chairs.

2. Description of the Related Art

Outdoor chairs provide users with convenient places to sit. Most outdoor chairs are not equipped to provide its users with protection from the elements, such as sun and rain. A beach umbrella is a common accessory for use with outdoor chairs. Beach umbrellas, however, are cumbersome to carry and operate. For example, as the sun travels across the sky, then the umbrella needs to be readjusted or the chair needs to be repositioned to a new location. Existing canopy-like accessories that have been designed for mounting on outdoor chairs often provide inadequate protection from the elements.

SUMMARY OF THE INVENTION

The illustrative embodiments described herein disclose an adjustable seating canopy that is removably mounted to a seat. In an illustrative embodiment, the canopy includes a set of frame elements that defines a curved shape of the canopy. The canopy includes a set of air channels that are formed by partially joining two layers of fabric that form the canopy. The set of air channels are oriented substantially perpendicular to an arced axis traveled by at least one frame element in the set of frame elements. The canopy includes a set of pivoting mechanisms attached to one or more frame elements which causes the canopy to be adjustably positioned above the chair along the arced axis. The canopy also includes a set of detachable clamping devices for mounting the canopy to the chair.

DETAILED DESCRIPTION OF THE PREFERRED EMBODIMENT

A chair accessory is disclosed herein for use with currently existing or later developed chairs. Non-limiting examples of chairs on which the chair accessory may be mounted include lawn chairs, recliners, wheelchairs, motorized chars, and high chairs. In particular, the chair accessory is a removable and adjustable canopy that enables a user to easily adjust the amount of coverage provided by the canopy from a seated position. A curved shape of the canopy provides a user with more protection from elements, such as sun and rain, than traditional beach umbrellas or existing flat-top canopies. For example, a user seated in an ordinary lawn chair protected from the sun by a beach umbrella or flat canopy accessory may be protected from the sun when the sun is high in the sky. However, as the sun moves across the sky and begins to set, the user is no longer protected from the sun and must readjust the seat or the umbrella in order to remain in the shade. The curved canopy disclosed herein provides the user more protection from the sun when the sun is lower in the sky. As such, the canopy disclosed herein requires less manipulation.

In addition, the canopy disclosed herein includes a set of air channels that dissipates lift that may be generated from air currents that may push against a lower surface of the canopy. The set of air channels reduces the likelihood that the chair and/or canopy will be damaged in the presence of wind.

Accordingly, the illustrative embodiments described herein disclose an adjustable seating canopy that is removably mounted to a seat. In an illustrative embodiment, the canopy includes a set of frame elements that defines a curved shape of the canopy. The canopy includes a set of air channels that are formed by partially joining two layers of fabric that form the canopy. In addition, the set of air channels are oriented substantially perpendicular to an arced axis traveled by at least one frame element in the set of frame elements. The canopy includes a set of pivoting mechanisms attached to one or more frame elements which causes the canopy to be adjustably positioned above the chair along the arced axis. The canopy also includes a set of detachable clamping devices for mounting the canopy to the chair.

The arced axis is the path traveled by pivoting frame elements incorporated into the canopy when the canopy is moved from a fully retracted position to a fully extended position. In an illustrative example, the arced path may be defined by selecting a point on a movable frame element that is equidistant from the ends of that frame element and plotting that point through space as the canopy is moved from a fully retracted position to a fully extended position. Frame elements from the set of frame elements travel along the arced path when the canopy is retracted and extended.

Figure 1:
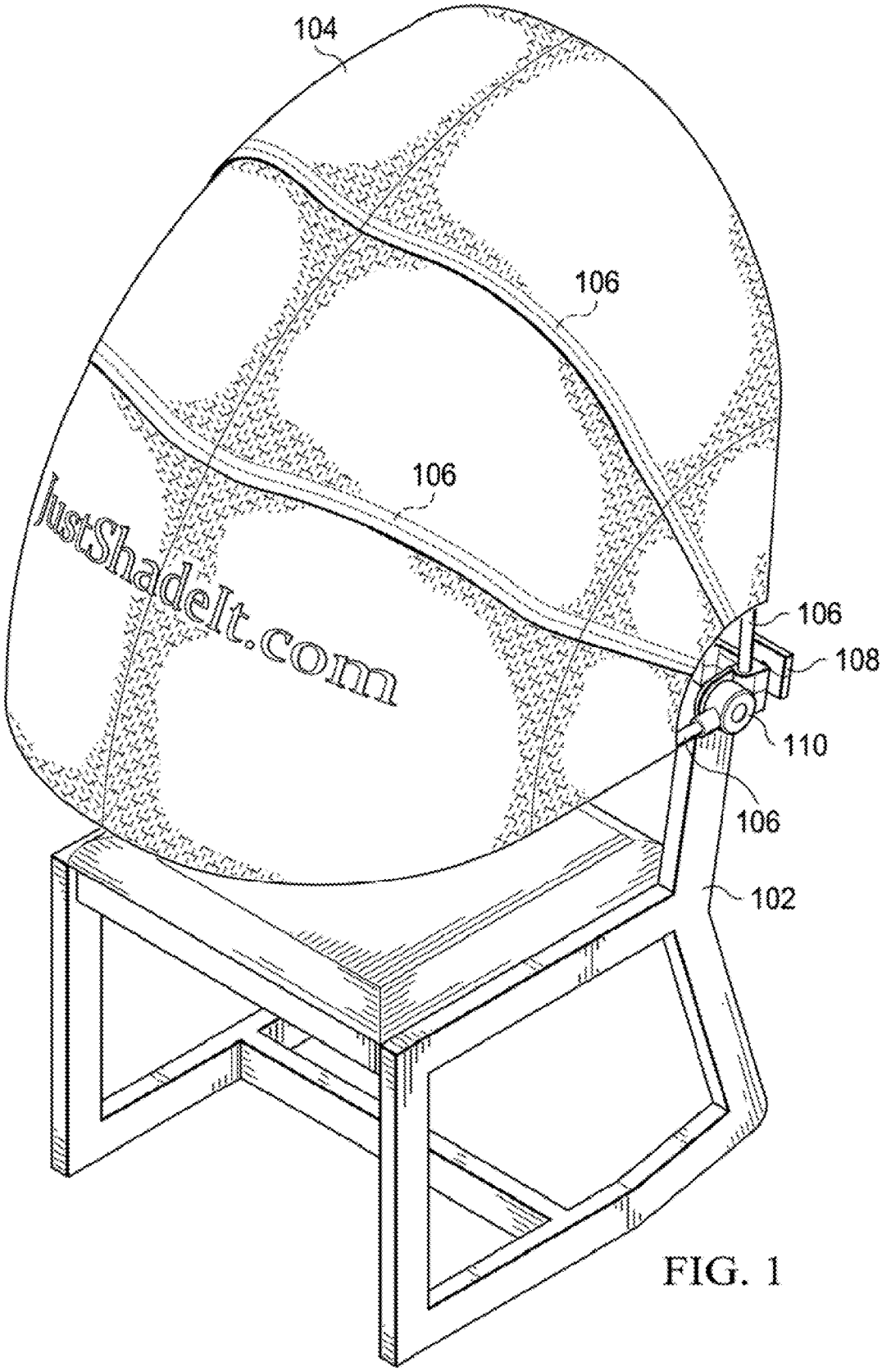
FIG. 1 is a front quarter isometric view of a removable and adjustable canopy mounted on a chair in accordance with an illustrative embodiment.

FIG. 1 is a front quarter isometric view of a removable and adjustable canopy mounted on a chair in accordance with an illustrative embodiment. Chair 102 is a seating surface that generally includes a seat, a backrest, and a set of legs joined to the seat. Non-limiting examples of chair 102 may include lawn chairs, beach chairs, patio chairs, or other currently existing or later designed chairs.

In this illustrative example in FIG. 1, chair 102 is mounted with canopy 104. Canopy 104 is an accessory for chair 102 which provides a user (not shown) seated in chair 102 with a barrier against the sun or precipitation. In one embodiment, canopy 104 is formed from fabric stretched over set of frame elements 106. Set of frame elements 106 is one or more supports for giving canopy 104 a semi-rigid framework that is curvilinear in shape. The curvilinear shape of canopy 104 provides a user with more protection from the sun than traditional beach umbrellas or canopies, as previously discussed.

As used herein, the term "set of" means one or more. Thus, a set of frame elements is one or more frame elements. In the illustrative example in FIG. 1, set of frame elements 106 includes four frame elements. In addition, the frame elements from set of frame elements 106 may be slideably inserted into sleeves stitched into canopy 104. In this manner, the fabric of canopy 104 may be replaced without a need for replacing set of frame elements 106.

At least one frame element from set of frame elements 106 is pivotably joined to set of clamping devices 108. Set of clamping devices 108 is one or more fasteners for mounting canopy 104 to chair 102. In particular, set of frame elements 106 is pivotably joined to set of clamping devices 108 using set of pivoting mechanisms 110. Set of pivoting mechanisms 110 is a component of set of clamping devices 108 that enables one or more frame elements from set of frame elements 106 to pivot with reference to set of clamping devices 108. The pivoting of the one or more frame elements with reference to set of clamping devices 108 enables a user to extend or retract canopy 104. For example, a user may retract canopy 104 so that the user may take a seat on chair 102 without interference from canopy 104. Once seated, the user may fully or partially extend canopy 104 to obtain a desired amount of shade. The manipulation of canopy 104 is discussed in more detail in FIG. 5 below.

Figure 2:
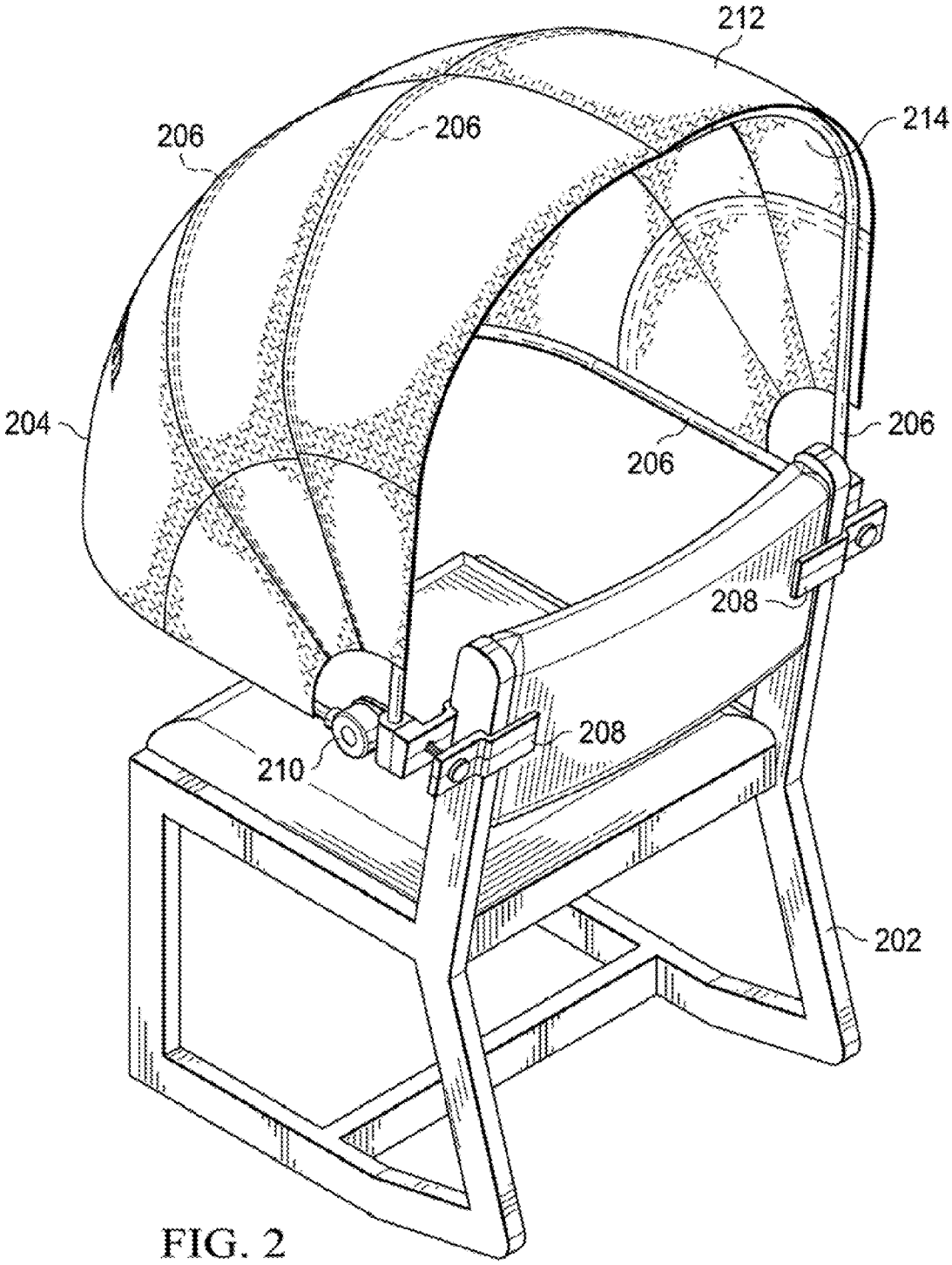
FIG. 2 is a rear quarter isometric view of a removable and adjustable canopy mounted on a chair in accordance with an illustrative embodiment.

FIG. 2 is a rear quarter isometric view of a removable and adjustable canopy mounted on a chair in accordance with an illustrative embodiment. Chair 202 and canopy 204 is a chair and canopy combination such as chair 102 and canopy 104 in FIG. 1, respectively. Canopy 204 includes set of frame elements 206, which is a set of frame elements such as set of frame elements 106 in FIG. 1.

Canopy 204 is mounted to chair 202 using set of clamping devices 208. Set of clamping devices 208 is a set of clamping devices such as set of clamping devices 108 in FIG. 1. In particular, one or more frame elements from set of frame elements 206 is joined to set of pivoting mechanisms 210 of set of clamping devices 208 to enable canopy 204 to be extended and/or retracted.

Canopy 204 includes a set of air channels (not shown) which permits air to flow between upper surface 212 and lower surface 214. Upper surface 212 is a surface of canopy 204 that is facing away from chair 202 when canopy 204 is mounted to chair 202. Similarly, lower surface 214 is a surface of canopy 204 which is facing toward chair 202 when canopy 204 is mounted to chair 202. The air flow between upper surface 212 and lower surface 214 eliminates or reduces any lift that may be generated from wind that may blow against a surface of canopy 204, such as lower surface 214. An illustration depicting the flow of air through air channels of canopy 204 between an upper surface and lower surface of canopy 204 is presented in FIG. 5.

Figure 3:
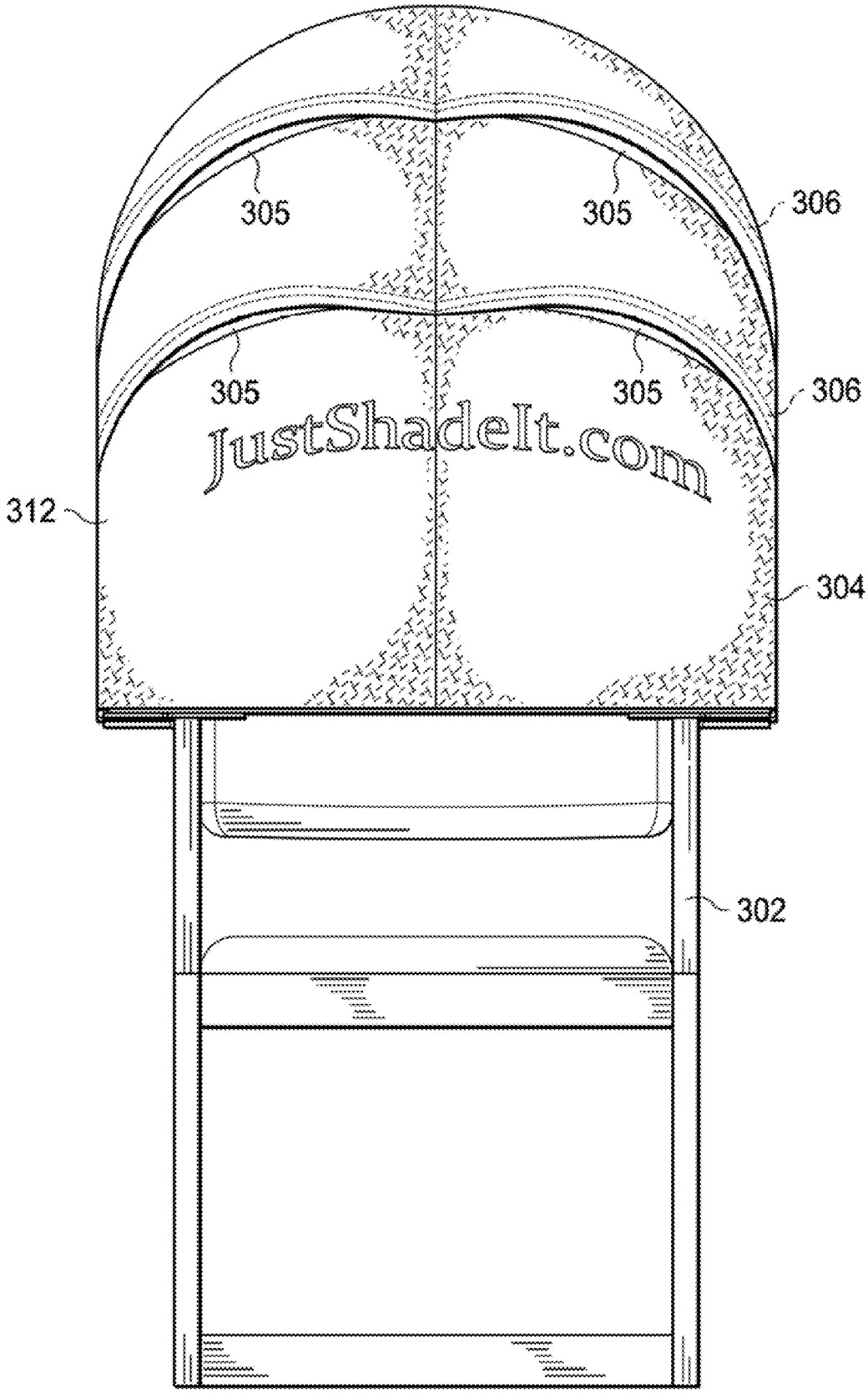
FIG. 3 is a front isometric view of a removable and adjustable canopy mounted on a chair in accordance with an illustrative embodiment.

FIG. 3 is a front isometric view of a removable and adjustable canopy apparatus mounted on a chair in accordance with an illustrative embodiment. Chair 302 and canopy 304 is a chair and canopy such as chair 102 and canopy 104 in FIG. 1, respectively. A curvilinear shape of canopy 304 is introduced by set of frame elements 306. Set of frame elements 306 are frame elements such as set of frame elements 106 in FIG. 1.

Canopy 304 includes set of air channels 305. Set of air channels 305 are conduits through which air may travel. Set of air channels 305 eliminates any lift that may be generated when wind pushes against a surface of canopy 304. For example, if wind blows against a lower surface of canopy 304 (from the rear of chair 302) in the absence of set of air channels 305, lift may be generated that may cause chair 302 and canopy 304 to be tipped over or blown away. Where a user is seated in chair 302, wind blowing on the lower surface of canopy 304 may cause canopy 304 to be forcibly removed from chair 302, thereby damaging canopy 304 and/or chair 302.

Figure 5:
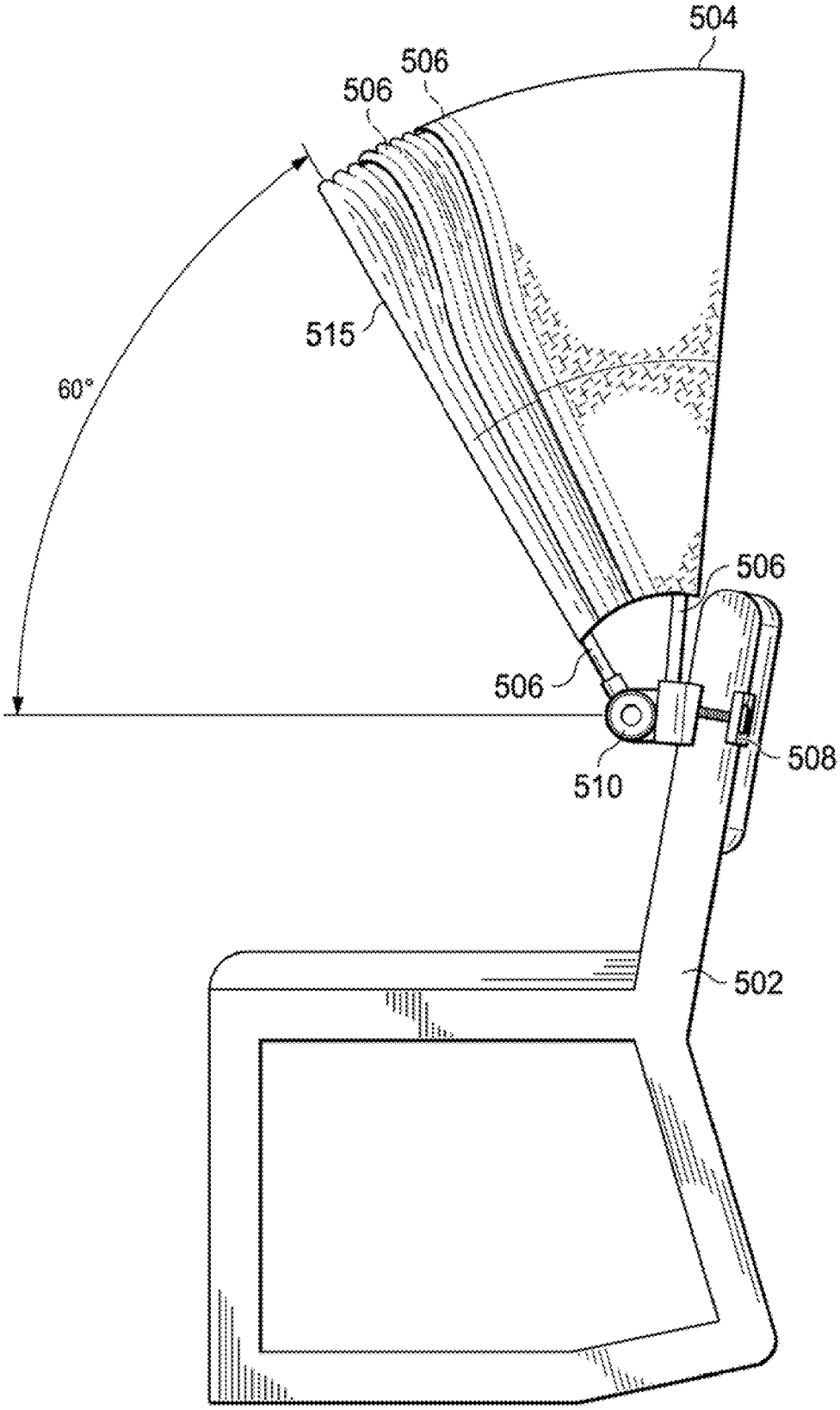
FIG. 5 is a side isometric view of a partially raised canopy in accordance with an illustrative embodiment.

Set of air channels 305 are oriented substantially perpendicular to an arced path traveled by a leading edge of canopy 304 as canopy 304 is moved between a retracted position and an extended position. A leading edge of canopy 304, which is described in more detail in FIG. 5, is an edge of canopy 304 which is formed by a frame element that is pivotably attached to a pivoting mechanism, such as set of pivoting mechanisms 110 in FIG. 1. In addition, the leading edge of canopy 304 is defined by the frame element from set of frame elements 306 which is capable of moving at least ninety (90) degrees to enable canopy 304 to be fully extended and fully retracted.

Set of air channels 305 are formed by overlapping layers of fabric of canopy 304. In particular, an air channel is formed by overlapping layers of fabric that are joined at two endpoints such that air is capable of traveling between the two layers of fabric, in a region between the two endpoints. The overlapping layers of fabric are similar to the overlapping of shingles on a roof, a configuration which prevents water from coming into contact with material beneath the shingles. Similarly, this overlapping configuration prevents water and sun from traveling from upper surface 312 to a lower surface (not shown) of canopy 304. Consequently, a user seated on chair 302 and beneath canopy 304 would be shielded from sun and/or rain, but any wind that may blow would be permitted to travel between upper surface 312 and a lower surface when the wind blows toward chair 302 from the front or back. As previously indicated, the movement of air between upper surface 312 and a lower surface of canopy 304 would eliminate any lifting effect that would otherwise be generated by the movement of air against a surface of canopy 304.

In an illustrative example, the placement of set of air channels 305 so that set of air channels 305 is substantially perpendicular to the arced path traveled by a leading edge of canopy 304 means that the set of air channels 305 is placed in the front of canopy 304 instead of on the sides of canopy 304. The forward placement of set of air channels 305 enables a greater amount of air to pass between upper surface 312 and a lower surface of canopy 304 when air currents approach chair 302 from the front or back.

Figure 4:
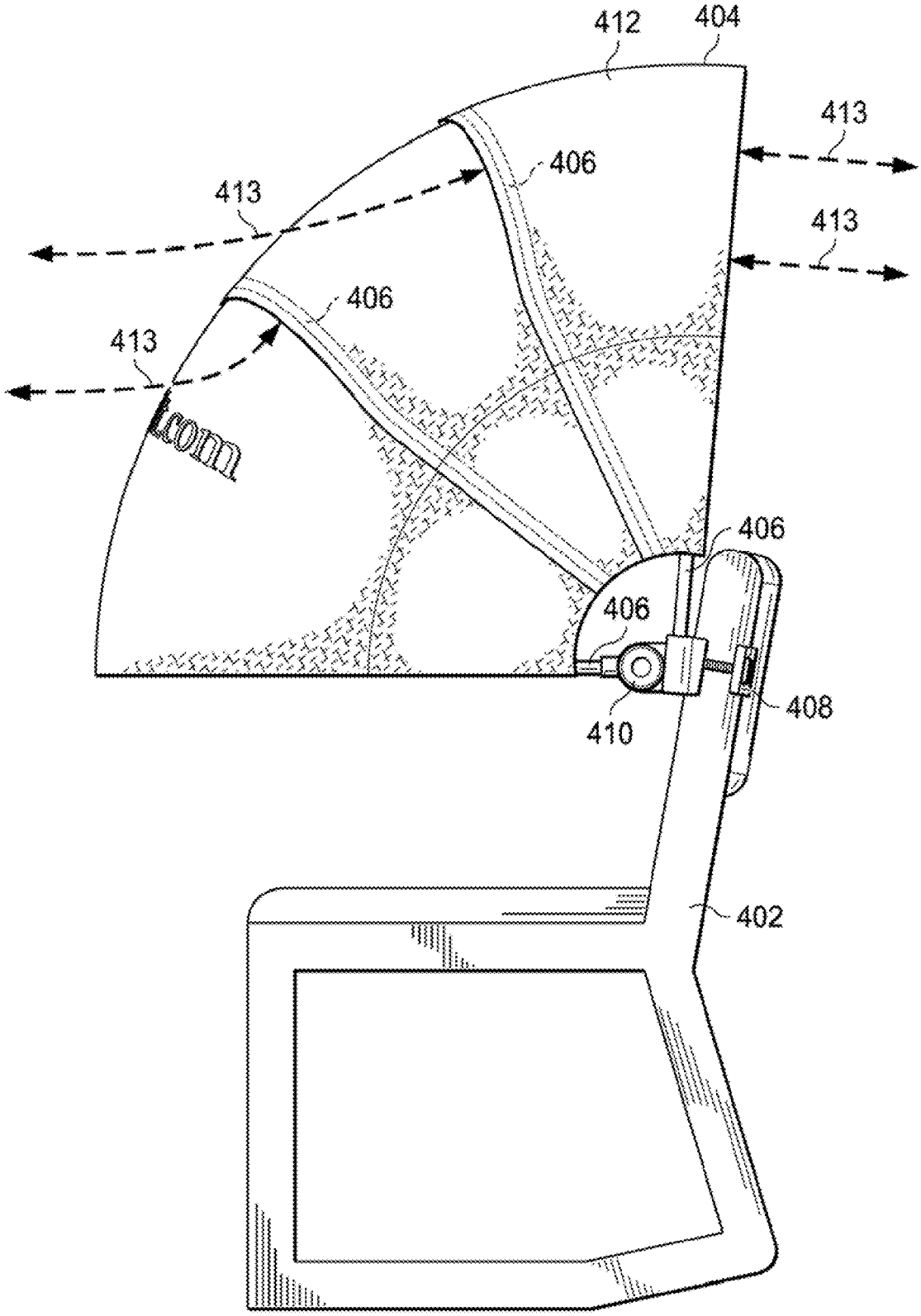
FIG. 4 is a side isometric view of a removable and adjustable canopy mounted on a chair in accordance with an illustrative embodiment.

FIG. 4 is a side isometric view of a removable and adjustable canopy mounted on a chair in accordance with an illustrative embodiment. Chair 402 and canopy 404 is a chair and canopy such as chair 102 and canopy 104 in FIG. 1, respectively. Furthermore, canopy 404 includes set of frame elements 406, one or more of which are pivotably joined to set of clamping devices 408. In particular, frame elements in set of frame elements 406 are pivotably joined to set of clamping devices 408 through set of pivoting mechanisms 410. Set of pivoting mechanisms 410 is a set of pivoting mechanisms such as set of pivoting mechanisms 110 in FIG. 1.

FIG. 4 illustrates the flow of air between upper surface 412 and a lower surface of canopy 404. Air currents 413 is a flow of air between upper surface 412 and a lower surface (not shown) of canopy 404. The passage of air currents 413 from one side of canopy 404 to the other is made possible by the existence of a set of air channels, such as set of air channels 305 in FIG. 3. The illustrative embodiment in FIG. 4 also depicts the overlapping layers of fabric that form canopy 404 which prevents sun and rain from traveling from tipper surface 412 to a lower surface (not shown) of canopy 404.

FIG. 5 is a side isometric view of a partially raised canopy in accordance with an illustrative embodiment. Chair 502 and canopy 504 is a chair and canopy combination such as chair 102 and canopy 104 in FIG. 1.

Canopy 504 includes set of frame elements 506, which are a set of frame elements such as set of frame elements 106 in FIG. 1. In addition, frame elements from set of frame elements 506 are joined to set of clamping devices 508 through set of pivoting mechanisms 510. Set of clamping devices 508 is a set of clamping devices such as set of clamping devices 108 in FIG. 1. Similarly, set of pivoting mechanisms 510 is a set of pivoting mechanisms such as set of pivoting mechanisms 110 in FIG. 1.

In this illustrative example, one frame element from set of frame elements 506 is rotationally joined to set of pivoting mechanisms 510 to form leading edge 515. Leading edge 515 is an edge or lip of canopy 504 that is capable of traveling in an arced path between a fully retracted position and a fully extended position.

In one embodiment, the fully retracted position, leading edge 515 is substantially perpendicular to the ground. Similarly, in this embodiment, leading edge 515 is substantially parallel to the ground in the fully extended position. Thus, in this non-limiting embodiment, leading edge 515 may travel approximately ninety degrees from the fully retracted position to the fully extended position. Set of pivoting mechanisms 510 may also enable leading edge 515 to be manipulated into a partially extended position, which is a position between the fully retracted position and the fully extended position.

A user may elect to move leading edge 515 to control the amount of protection from elements such as sun, wind, or rain. For example, a user seated in chair 502 may gradually adjust leading edge 515 to manipulate canopy 504 from a fully retracted position to a fully extended position throughout a day as the sun moves across the sky. In this manner, the user may maintain a source of shade on the user's face throughout the day depending upon the position of the sun. Likewise, a user may elect to move leading edge 515 from a partially extended position to a fully extended position during a rainstorm in an attempt to remain dry. In FIG. 5, leading edge 515 is partially raised to illustrate a partially extended canopy 504.

It will be appreciated that while a preferred embodiment has been disclosed herein, other modifications, features, and advantages within the present scope of the present invention will become apparent to those skilled in the art. Accordingly, the discussion of the preferred embodiments herein is illustrative and not restrictive. It is intended that the claims will cover all such modifications which come within the spirit and scope of the present invention.

What is claimed is:

1. A canopy for a chair, the canopy comprising:

a set of curvilinear frame elements for defining a curvilinear shape of the canopy;

at least a first frame element of the set of the frame elements a fabric canopy stretched over the set of curvilinear frame elements for defining a curvilinear shape of the canopy;

a set of linearly oriented sleeves stitched into the fabric of the canopy, wherein the set of frame elements are slidably insertable into and removable from the set of sleeves stitched into the fabric of the canopy;

a set of detachable left and right clamping devices for mounting the canopy to the chair;

a set of left and right pivoting mechanisms attached to the left and right clamping devices;

at least one frame element of the set of frame elements attached to the left and right pivoting mechanisms, wherein the first frame element forms a leading edge of the canopy;

at least a second frame element of the set of frame elements is immovably joined to the set of left and right detachable clamping devices, the pivoting mechanisms allowing the at least one frame element to travel along an arced axis in a ninety degree arc with respect to the at least second frame element, wherein the set of pivoting mechanisms causes the canopy to be adjustably positioned above the chair along the arced axis;

a set of air channels in the canopy, wherein the set of air channels are formed by partially joining two layers of fabric of the canopy at two endpoints, wherein the set of air channels are conduits through which air travels, wherein air travels through the set of air channels eliminate lift generated when wind pushes against a surface of the canopy, and wherein the set of air channels are oriented substantially perpendicular to an arced axis traveled by at least one frame element in the set of frame elements.

2. The canopy of claim 1, wherein the canopy comprises an upper surface and a lower surface, and wherein the set of air channels permits air to travel between the upper surface and the lower surface.

3. The canopy in claim 1, wherein the set of air channels are located substantially parallel to one or more frames in the set of frames.

4. The canopy in claim 1, wherein the leading edge of the canopy travels along the arced axis between a fully retracted position and a fully extended position.

5. The canopy in claim 1, wherein the two layers of the fabric forming an air channel in the set of air channels are joined at each end of the air channel to define an opening between each joined end.

* * * * *